US008925514B2

(12) United States Patent
Bowman

(10) Patent No.: US 8,925,514 B2
(45) Date of Patent: Jan. 6, 2015

(54) METHOD FOR IMPROVING WARM-UP OF AN ENGINE

(71) Applicant: Ford Global Technologies, LLC, Dearborn, MI (US)

(72) Inventor: Timothy James Bowman, Bexley (GB)

(73) Assignee: Ford Global Technologies, LLC, Dearborn, MI (US)

( * ) Notice: Subject to any disclaimer, the term of this patent is extended or adjusted under 35 U.S.C. 154(b) by 98 days.

(21) Appl. No.: 13/666,708

(22) Filed: Nov. 1, 2012

(65) Prior Publication Data

US 2013/0118425 A1 May 16, 2013

(30) Foreign Application Priority Data

Nov. 10, 2011 (GB) ..... 1119371.1

(51) Int. Cl.

| | |
|---|---|
| ***F01P 7/14*** | (2006.01) |
| ***F02P 7/00*** | (2006.01) |
| ***F01P 7/02*** | (2006.01) |
| ***F01P 5/10*** | (2006.01) |
| ***F01M 5/00*** | (2006.01) |
| ***F01P 7/16*** | (2006.01) |
| ***F01M 5/02*** | (2006.01) |

(52) U.S. Cl.

CPC *F01P 7/14* (2013.01); *F01M 5/005* (2013.01); *F01P 7/164* (2013.01); *F01M 5/001* (2013.01); *F01M 5/021* (2013.01); *F01P 2037/02* (2013.01); *F01P 2060/04* (2013.01); *F01P 2060/06* (2013.01)

USPC ..... 123/196 AB; 123/41.01; 123/41.02; 123/41.04; 123/41.05; 123/41.44; 123/142.5 R; 123/142.5 E

(58) Field of Classification Search

USPC ..... 123/41.01, 41.02, 41.04, 41.05, 41.44, 123/142.5 R, 142.5 E, 196 AB; 417/293

See application file for complete search history.

(56) References Cited

U.S. PATENT DOCUMENTS

| | | | | |
|---|---|---|---|---|
| 3,207,077 | A * | 9/1965 | Zeigler et al. | 417/300 |
| 4,114,571 | A * | 9/1978 | Ruf | 123/41.35 |
| 4,192,274 | A * | 3/1980 | Damon | 123/142.5 R |
| 4,204,487 | A * | 5/1980 | Jones | 123/41.35 |
| 4,386,735 | A | 6/1983 | Tholen et al. | |
| 4,434,934 | A | 3/1984 | Moser et al. | |
| 5,050,936 | A * | 9/1991 | Tanaka et al. | 303/3 |
| 5,111,775 | A * | 5/1992 | Sumida et al. | 123/41.1 |
| 6,598,705 | B2 * | 7/2003 | Ito et al. | 184/6.5 |
| 7,069,883 | B2 * | 7/2006 | Atkins | 123/41.81 |
| 7,370,612 | B2 * | 5/2008 | Hanai | 123/41.14 |
| 7,421,983 | B1 * | 9/2008 | Taylor | 123/41.01 |
| 7,735,461 | B2 * | 6/2010 | Vetrovec | 123/41.14 |

(Continued)

FOREIGN PATENT DOCUMENTS

GB 2088550 A 10/1981

*Primary Examiner* — Lindsay Low
*Assistant Examiner* — Tea Holbrook
(74) *Attorney, Agent, or Firm* — Julia Voutyras; Alleman Hall McCoy Russell & Tuttle LLP

(57) ABSTRACT

A method is disclosed for heating a liquid supplied to an engine of a motor vehicle by a pump when the temperature of the liquid is low, thereby reducing the operating efficiency of the engine. The method comprises inefficient operation of the pump by constricting flow to create heat that is transferable to the liquid. Inefficient operation of the pump is enacted when service brakes are applied and the vehicle is decelerating to minimize negative impact on fuel economy and overall engine efficiency.

16 Claims, 4 Drawing Sheets

(56) References Cited

U.S. PATENT DOCUMENTS

| | | | | |
|---|---|---|---|---|
| 2002/0073942 | A1* | 6/2002 | Hollis | 123/41.44 |
| 2003/0089319 | A1* | 5/2003 | Duvinage et al. | 123/41.02 |
| 2005/0006487 | A1* | 1/2005 | Suda et al. | 236/46 R |
| 2007/0261648 | A1* | 11/2007 | Reckels et al. | 123/41.12 |
| 2008/0295791 | A1* | 12/2008 | Holler et al. | 123/142.5 R |
| 2009/0183697 | A1* | 7/2009 | Inui | 123/41.02 |
| 2010/0095908 | A1* | 4/2010 | Deivasigamani | 123/41.1 |
| 2012/0285413 | A1* | 11/2012 | Pingen et al. | 123/196 AB |

* cited by examiner

METHOD FOR IMPROVING WARM-UP OF AN ENGINE

CROSS REFERENCE TO RELATED APPLICATIONS

The present application claims priority to United Kingdom Patent Application No. 1119371.1, filed on Nov. 10, 2011, the entire contents of which are hereby incorporated by reference for all purposes.

TECHNICAL FIELD

The present disclosure relates to internal combustion engines and in particular to a method for improving the warm-up of an internal combustion engine of a motor vehicle.

BACKGROUND AND SUMMARY

The fuel efficiency of an internal combustion engine is greatest when it is warm, that is, when its oil and coolant have reached their normal operating temperatures. Before these conditions are reached the engine operates at sub-optimal efficiency. Consequently, measures to expedite the warm-up, particularly of engine oil, but also of coolant, will decrease a vehicle's fuel consumption.

It is further known that the production of exhaust emissions from an engine are high when the engine is first started from cold. That is to say, when the engine is cold more emissions are produced for a specific fuel consumption compared to the situation when the engine is operating at, or substantially at, its normal running temperature.

It is desirable to reduce the fuel consumption of an engine in order to reduce the running costs of the engine and the emissions from the engine. It will be appreciated by those skilled in the art that the emissions from an engine are closely related to the volume of fuel consumed by the engine and this is particularly so in the case of CO2 emissions.

Two factors of an engine cold start affecting fuel economy are:

1) Cold Start Cranking (CSC); and

2) Engine Warm Up (EWU).

For CSC the starter motor normally rotates an engine with cold, thick, viscous engine oil and poor lubrication, and hence high friction internal engine components. Both high oil viscosity and poor lubrication increase demand for the starter motor, directly putting an additional drain upon the vehicles battery. The battery charge is replenished via the alternator, when the engine has started, but at a cost to fuel economy.

For EWU, once the engine has started, the engine again works harder to overcome the cold and viscous engine oil until optimum engine operating temperatures and related low oil viscosity is achieved. During EWU extra fuel is consumed to compensate for higher frictional losses at a further cost to fuel economy.

It is therefore known that reducing the viscosity of a conventional lubricant used to lubricate an engine is desirable in general, but specifically during the warm up phase. Decreasing lubricant viscosity reduces fuel consumption due to reduced frictional losses, reduced pumping losses and a reduction in the power required to pump the lubricant through the engine.

Many modern engines have variable oil pumps for engine lubrication. These vary the flow rate of lubricant passing through the engine with the intention of minimizing the parasitic losses of the oil pump and thereby increasing fuel efficiency. For instance, at low load operating points the oil pump is set to provide a low flow rate output. Conversely, at high load operating conditions such as at peak power, the oil pump is set to provide close to maximum flow rate output. In other words, the flow rate is matched to the demand of the engine. An undesired implication of this matching is that the oil will not warm-up as quickly thereby having a detrimental effect on fuel consumption and emission production. It will also be appreciated that improving the warm-up rate of the coolant circulating through an engine is beneficial because this will also have an effect on fuel efficiency and emission production. It is an object of this disclosure to provide a method of improving engine warm-up in a fuel efficient manner.

To solve at least some of the aforementioned disadvantages a method to increase the rate of engine warm-up is provided. The method comprises opening a flow control valve in a liquid circuit when the temperature of the liquid within the liquid circuit is above a predefined threshold temperature. Then constricting the flow of the liquid within the liquid circuit when a temperature of the liquid is below the predefined threshold temperature and a vehicle deceleration rate is above a predefined deceleration rate. In addition to confining the restriction of liquid flow to a period when the vehicle is decelerating, the method could be enacted when the vehicle is in an over-run situation, but not necessarily decelerating, or when prevention of acceleration is advantageous, such as maintaining speed during a downhill descent. This constriction of a line within the liquid circuit requires more work of a pump within the liquid circuit. The inefficient operation of the pump creates heat transferable to the liquid, more readily warming it up and decreasing liquid viscosity. Enacting the method of the present disclosure when the vehicle is decelerating minimizes, or negates, negative impact of inefficient pump operation on fuel economy and overall engine efficiency.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1A:
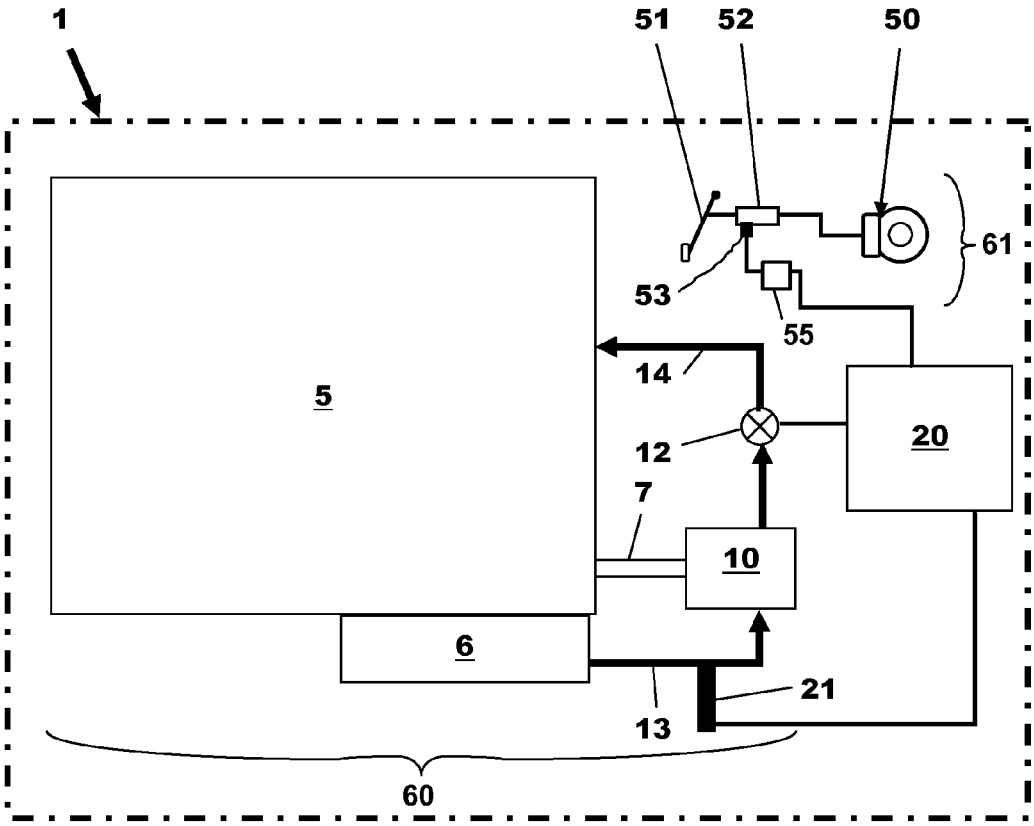
FIG. 1*a* is a schematic diagram of a motor vehicle with associated oil circuit.

According to a first aspect of the disclosure there is provided a method for improving warm-up of an engine of a motor vehicle having a pump to circulate liquid through the engine, the pump being operable in at least a normal operating mode and a heating mode of operation wherein the method comprises using the heating mode of operation to heat the liquid passing through the pump if the motor vehicle is decelerating or operating in an over-run situation. An over-run situation being when throttle is closed or closing and additional power outage by the engine is not needed to propel the vehicle.

The motor vehicle may further comprise service brakes to decelerate the motor vehicle in response to a driver input and the method may further comprise using the heating mode of operation to heat the liquid passing through the pump if the service brakes of the motor vehicle have been activated. The method may further comprise using the heating mode of operation to heat the liquid passing through the pump if the service brakes of the motor vehicle have been activated sufficiently to produce a deceleration of the vehicle above a predefined level. In other embodiments, the heating mode of operation may be initiated at times when the vehicle is not explicitly decelerating, such as during downhill descent in an over-run situation, without requiring additional work of the engine which negatively influences fuel economy.

The method may further comprise using the heating mode if the temperature of the liquid is below a predefined temperature. The method may further comprise determining the temperature of the liquid and operating the pump in the heating mode if the determined temperature of the liquid is below the predefined temperature.

In the heating mode of operation, the pump may be operated inefficiently so as to generate heat in the liquid passing through the pump. In the heating mode of operation, the flow of liquid from the pump may be restricted so as to generate heat in the liquid passing through the pump. The method may further comprise providing a flow control valve on an outlet side of the pump and closing the flow control valve to a flow restricting position when the pump is operated in the heating mode of operation. The pump may be driven by the engine. The liquid may be at least one of lubricating oil for the engine and coolant for the engine.

According to a second aspect of the disclosure there is provided a motor vehicle having an engine, a pump operable in at least a normal operating mode and a heating mode of operation to circulate liquid through the engine and an electronic controller wherein the electronic controller is operable to operate the pump in the heating mode of operation to heat the liquid passing through the pump if the motor vehicle is decelerating.

The motor vehicle may further comprise service brakes to decelerate the motor vehicle in response to a driver input and the controller may be operable to operate the pump in the heating mode of operation to heat the liquid passing through the pump if the service brakes of the motor vehicle have been activated.

The electronic controller may be operable to operate the pump in the heating mode of operation to heat the liquid passing through the pump if the service brakes of the motor vehicle have been activated sufficiently to produce a deceleration of the vehicle above a predefined level.

The electronic controller may be operable to operate the pump in the heating mode if the temperature of the liquid passing through the pump is below a predefined temperature.

A flow control valve may be located on an outlet side of the pump and the electronic controller may be used to control the opening and closing of the control valve and, in the heating mode of operation, the electronic controller is operable to close the flow control valve to a flow restricting position so as to produce a restriction in flow of liquid from the pump and generate heat in the liquid passing through the pump.

The pump may be driven by the engine.

The liquid may be one of lubricating oil for the engine and coolant for the engine.

The motor vehicle may have an oil pump and a coolant pump each operable in at least a normal operating mode and a heating mode of operation to oil and coolant through the engine and the electronic controller may be operable to operate both of the pumps in the heating mode of operation to heat the liquids passing through their respective pumps if the motor vehicle is decelerating. The oil pump may circulate lubricating oil through the engine, an oil flow control valve may be located on an outlet side of the oil pump, a coolant pump may circulate coolant through the engine, a coolant flow control valve may be located on an outlet side of the coolant pump and the electronic controller may control the opening and closing of the oil and coolant control valves to provide said normal and heating modes of operation respectively.

When the oil pump is operated in the heating mode of operation, the flow of oil from the oil pump may be restricted so as to generate heat in the oil passing through the oil pump and the electronic controller may be operable to close the oil flow control valve to a flow restricting position so as to produce the restriction in flow of oil from the pump and, when the coolant pump is operated in the heating mode of operation, the flow of coolant from the coolant pump may be restricted so as to generate heat in the coolant passing through the coolant pump and the electronic controller may be operable to close the coolant flow control valve to a flow restricting position so as to produce the restriction in flow of coolant from the pump.

With particular reference to FIG. 1*a* there is shown a motor vehicle 1 having an engine system comprising an engine 5, a pump 10, a flow control valve 12 and an electronic controller 20. The motor vehicle 1 also has a brake assembly 61 including a number of service brakes 50 of which one is shown diagrammatically on FIG. 1*a*. The service brakes 50 are operated by a driver input in the form of a brake pedal 51 which operates a master cylinder 52 as is well known in the art. A brake sensor 53 is provided to determine when the service brakes 50 have been activated. The brake sensor 53 may be in the form of a switch such as the type of switch used to activate rear brake warning lights or could be a sensor that measures the pressure applied to the brake pedal 51 or the pressure of the hydraulic fluid supplied to the service brakes 50. If a pressure sensor is used then the magnitude of deceleration of the motor vehicle 1 can be estimated based upon known characteristics for the service brakes 50 and the motor vehicle 1. Additionally, deceleration can be monitored by accelerometer 55, by a change from vehicle speed from a vehicle speed sensor (not shown), or by inference from engine RPM or gear ratio. The output from the brake sensor 53 and accelerometer 55 are supplied to the electronic controller 20.

Figure 2:
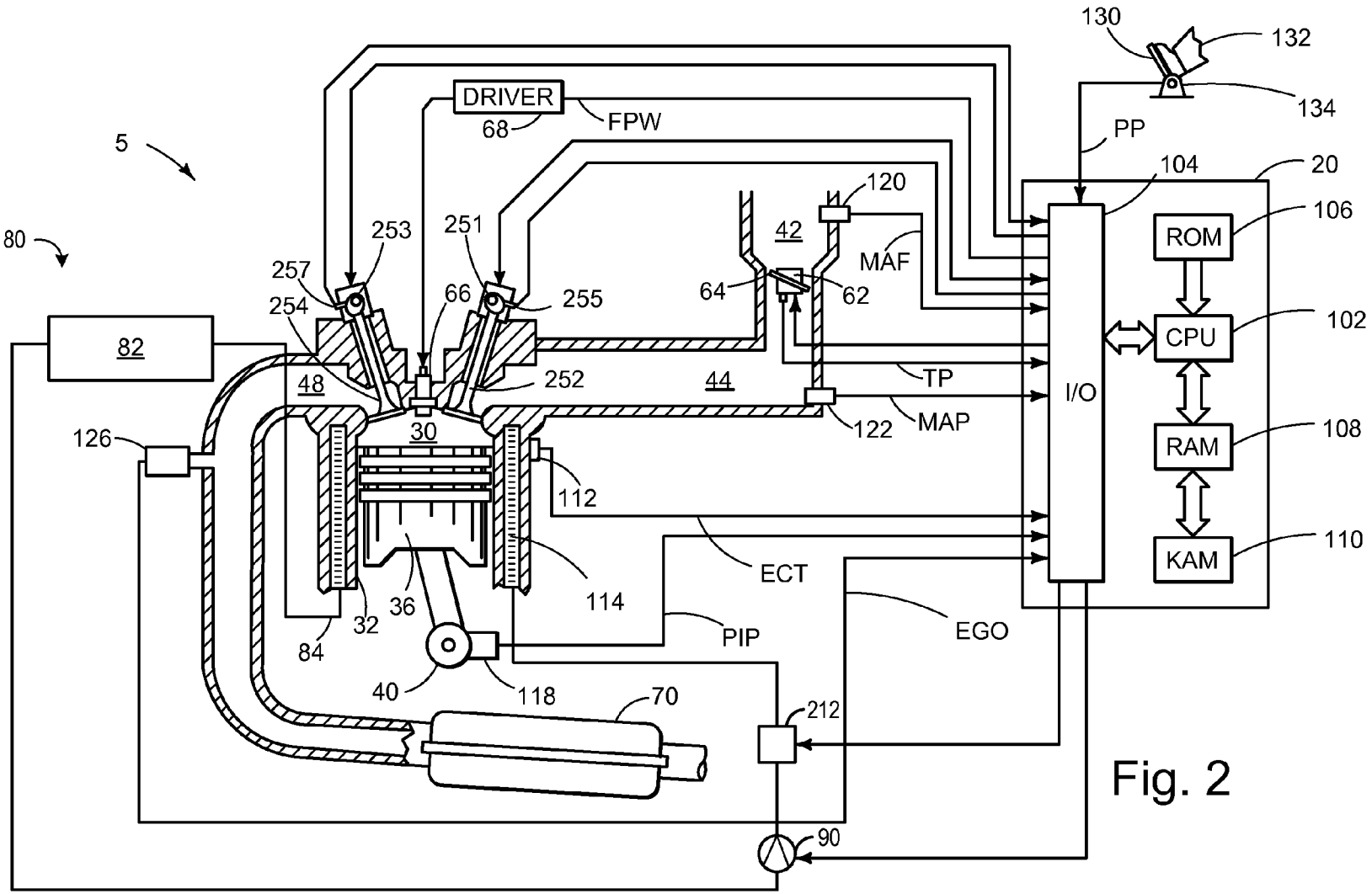
FIG. 2 is a schematic diagram of an engine containing a hybrid coolant system.

The pump in this case is an oil pump 10 for circulating lubrication oil through the engine 5 within oil circuit 60 but it will be appreciated that the pump could alternatively be a coolant pump for circulating coolant through a coolant circuit (as depicted in FIG. 2).

Oil is supplied to an inlet of the oil pump 10 from an oil reservoir such as an oil pan or sump 6 via an oil supply line 13 and is returned to the engine 5 from an outlet side of the oil pump 10 via an oil return line 14.

Figure 1B:
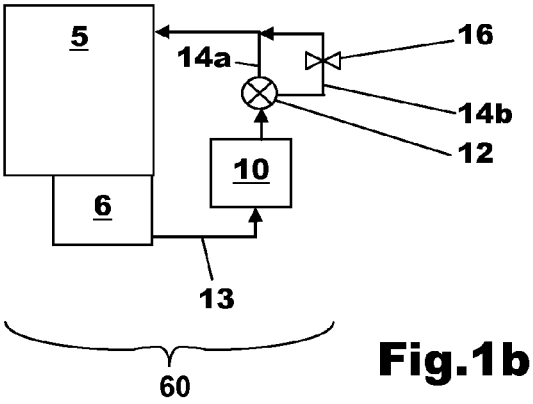
FIG. 1*b* is a schematic diagram of an alternative to the oil circuit shown in FIG. 1*a*.

It will be appreciated that the flow control valve 12 could be a separate component as shown in FIGS. 1*a* and 1*b* or could alternatively be formed as an integral part of the oil pump 10.

It will be further appreciated that the supply and return lines 13 and 14 could be partially formed as part of the structure of the engine 5.

The oil pump 10 is preferably driven directly by the engine 5 via a mechanical drive 7 such as a shaft drive, chain drive or belt drive. However, in other embodiments the oil pump 10 can be driven by a means other than the engine such as an electric motor or hydraulic motor (not shown).

The oil pump 10 can be of any known type and can be a fixed or a variable displacement type of pump.

The electronic controller 20 is operable to control the opening and closing of the flow control valve 12 in response to a temperature input indicative of the temperature of the oil from, in this case, a temperature sensor 21 located in the supply line 13. It will be appreciated that the temperature of the oil could be sensed in other locations such as, for example, the sump 6. Additional inputs to controller 20 from accelerometer 55, vehicle speed sensor (not shown) and from brake sensor 53 are used in the control of opening and closing flow control valve 12.

The electronic controller 20 is arranged to operate the pump 10 in two modes of operation, a normal mode in which the operation of the pump 10 is that which meets the operating needs of the engine 5 and a heating mode of operation in which the goal is to heat the oil. In the normal mode of operation the flow control valve 12 will normally be fully open if a variable flow pump is used. However, if oil flow is also affected via the flow control valve 12, opening and closing of the control valve 12 will be varied to produce the appropriate oil flow to the engine 5.

In the heating mode of operation, the flow control valve 12 will be closed to a position in which it produces a significant restriction to flow of oil from the oil pump 10. In one embodiment the flow control valve is a butterfly valve which is fully open when normal operation of the pump 10 is in use and is fully closed when the heating mode of operation is activated. In the open position substantially no restriction to flow is produced and when the butterfly valve is fully closed the restriction to flow is significant. Note that the butterfly valve may be of a slightly smaller diameter than the bore of the conduit in which it is mounted so that even when fully closed a small gap exists between the periphery of the butterfly valve and the supporting conduit. Other types of valve could be used and a butterfly valve is merely one example.

By restricting the flow of oil out of the oil pump during the heating mode of operation more energy has to be applied to the pump 10 in order to pump the oil, and the pumping losses will increase. The increased pumping losses result in the generation of heat in the pump thereby heating the oil flowing through the pump 10.

Although the extra energy used to operate the pump 10 during the heating mode of operation would normally result in a reduction in fuel efficiency because the engine 5 has to work harder to operate the pump 10, this increased fuel usage is not incurred in accordance with this disclosure because the heating mode is used when the motor vehicle 1 is decelerating, as indicated by accelerometer 55.

During deceleration of the motor vehicle 1 it is usual for the engine 5 to be operating in an over-run condition in which substantially no fuel is supplied to it and no additional fuel is supplied even if the heating mode is used. Therefore in one embodiment of the disclosure, if an over-run situation occurs the electronic controller 20 will operate the pump 10 in the heating mode but will otherwise use the normal mode of operation. An over-run situation can be deduced from a zero throttle opening, though over-run is possible with other throttle positions, or by the use of an accelerometer 55. Use of the heating mode of operation during an over-run situation when the vehicle is not necessarily decelerating will, similarly to operation strictly during deceleration, have minimal impact on overall engine efficiency. In a preferred embodiment of the disclosure, the vehicle deceleration is deduced from an activation of the service brakes 50. That is to say, the heating mode is used when the service brakes 50 are activated. In some embodiments this may be further restricted by requiring that the service brakes are producing a level of deceleration above a predefined limit to reduce the risk of the engine braking produced by the use of the heating mode of operation causing vehicle instability on low friction surfaces such as ice. The predefined level of deceleration will depend upon the characteristics of the motor vehicle 1 and could be an actual level of deceleration as measured by an accelerometer 55 or a pressure level, either pedal pressure, or pressure of the hydraulic fluid supplied to the service brakes 50 indicated by brake sensor 53 to engine controller 20. Additional information can be used to assess deceleration, such as vehicle speed from a vehicle speed sensor, or by inference from engine RPM, and gear ratio as supplied to engine controller 20. Characteristics of the motor vehicle used in determining a predefined level of deceleration could be the weight of the vehicle, type of motor, additional power demands, and/or operating speed.

Referring now to FIG. 1*b*, the diagram depicts an alternative arrangement for restricting the flow from the pump is shown. Like reference numerals have the same meaning as described with respect to oil circuit 60 within FIG. 1*a*. In this case the flow control valve 12 switches the flow between an unrestricted return line 14*a* and a restricted return line 14*b*. In this case the restricted flow return line 14*b* includes an orifice 16 but it will be appreciated that the restriction to flow could be achieved by using a return line having a small cross-sectional area.

During the normal mode of pump operation the unrestricted return line 14*a* is selected by the flow control valve 12 and in the heating mode of operation the restricted return line 14*b* is selected by the flow control valve 12.

As before, the flow control valve 12 is controlled by an electronic controller (not shown in FIG. 1*b*) based upon motor vehicle deceleration and liquid temperature. Likewise brake assembly 61 is not depicted in FIG. 1*b*, but is understood to be part of the larger motor vehicle 1 that the alternate embodiment of oil circuit 60 shown in FIG. 1*b* is housed in.

Furthermore, when the oil pump is operated in the heating mode of operation, the flow of oil from the oil pump 10 is restricted so as to generate heat in the oil passing through the oil pump 10 and the electronic controller 20 is operable to close the oil flow control valve 12 to a flow restricting position so as to produce the restriction in flow of oil from the oil pump 10.

When the coolant pump 90 is operated in the heating mode of operation, the flow of coolant from the coolant pump 90 is restricted so as to generate heat in the coolant passing through the coolant pump 90 and the electronic controller 20 is operable to close the coolant flow control valve to a flow restricting position so as to produce the restriction in flow of coolant from the pump.

Therefore in summary, in an analogous way to a Froude water brake used in an engine dynamometer, an oil pump or a coolant pump can be used to convert the energy applied to it into heat and this heat can be transferred to the liquid such as lubricant flowing through it. Consequently, when the oil pump 10 is operated in this heating mode, the engine lubricant temperature can be rapidly increased.

Although operating the oil pump 10 in the heating mode of operation would normally deteriorate fuel consumption this is minimised by limiting the heating to a period where the motor vehicle 1 is decelerating such as during an over-run condition when the service brakes 50 are activated. Although it is particularly useful for deceleration purposes if the oil pump 10 is directly driven by the engine 5, such as by mechanical drive shaft 7, it will be appreciated that even with an electrically driven pump an additional load will be supplied to the engine 5 via increased electrical demand that will result in increased engine braking.

Therefore by limiting the use of the heating mode of operation to a period where vehicle deceleration is occurring due to use of the service brakes 50, some of the energy normally expended into the service brakes 50 of the vehicle can be used to heat the oil or coolant. Therefore, instead of wasting energy in the form of increased brake temperature, the oil pump 10 can be set in the heating mode of operation to work in conjunction with the service brakes 50 thereby reducing the energy lost to the service brakes 50. Such a use eliminates any fuel penalty that would otherwise be incurred because during such braking conditions the engine 5 is operating in an overrun state.

As indicated above the disclosure can be applied to a coolant pump 90 with the aim of warming up the engine coolant quicker.

Although as described above a control valve is used to restrict the flow from the pump so as to make it operate inefficiently and generate heat it will be appreciated that, in the case of certain types of variable flow pump, the pump itself could be adjusted into a very inefficient operating state in order to provide heating without a flow control valve.

Referring now to FIG. 2 which schematically depicts an alternate embodiment of the disclosure involving a coolant circuit used to speed heating of the engine, in addition to, or opposed to the use of such a method in the oil circuits shown in FIGS. 1*a* and 1*b*. The engine 5 has coolant pump 90 situated within engine cooling system 80 that circulates water based coolant. The coolant pump 90 circulates coolant through the engine. A coolant flow control valve 212 is downstream of coolant pump 90. An electronic controller 20 is used to control the opening and closing of the coolant control valve 212. The coolant pump 90 is operated in a normal mode of operation to provide a flow of coolant to the engine and in a heating mode of operation so as to heat the coolant passing through the coolant pump 90 when heating of the coolant is beneficial. Heating of the coolant within engine cooling system 80 by coolant pump 90, is allowed if the motor vehicle is decelerating. Deceleration is deduced based on whether the service brakes 50 have been activated, as detected by brake sensor 53, and/or based on input to controller 20 from accelerometer 55 (shown in FIG. 1). With such an embodiment, the engine may also contain an oil pump, which is likewise, operated in a normal mode of operation to provide a flow of oil to the engine and in a heating mode of operation so as to heat the oil passing through the oil pump when heating of the oil is required.

More generally FIG. 2 depicts one cylinder of multi-cylinder engine 5, which may be included in a propulsion system of an automobile. Combustion in engine 5 can be of various types, depending on operating conditions. While FIG. 2 depicts a compression ignition engine, it will be appreciated that the embodiments described herein may be used in any suitable engine, including but not limited to, diesel and gasoline compression ignition engines, spark ignition engines, direct or port injection engines, etc. Further, various fuels and/or fuel mixtures such as diesel, bio-diesel, etc, may be used.

Engine 5 may be controlled at least partially by a control system including controller 20 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 5 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 5.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 252 and exhaust valve 254. In some embodiments, combustion chamber 30 may include two or more intake valves and/or two or more exhaust valves.

In this example, intake valve 252 and exhaust valves 254 may be controlled by cam actuation via respective cam actuation systems 251 and 253. Cam actuation systems 251 and 253 may each include one or more cams and may utilize one or more of cam profile switching (CPS), variable cam timing (VCT), variable valve timing (VVT) and/or variable valve lift (VVL) systems that may be operated by controller 20 to vary valve operation. The position of intake valve 252 and exhaust valve 254 may be determined by position sensors 255 and 257, respectively. In alternative embodiments, intake valve 252 and/or exhaust valve 254 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion chamber 30 for injecting fuel directly therein in proportion to the pulse width of signal FPW received from controller 20 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail. In some embodiments, combustion chamber 30 may alternatively or additionally include a fuel injector arranged in intake manifold 44 in a configuration that provides what is known as port injection of fuel into the intake port upstream of combustion chamber 30.

Intake passage 42 may include a throttle 62 having a throttle plate 64. In this particular example, the position of throttle plate 64 may be varied by controller 20 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 20 by throttle position signal TP. Intake passage 42 may include a mass air flow sensor 120 and a manifold air pressure sensor 122 for providing respective signals MAF and MAP to controller 20.

Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 (also referred to as a catalyst or exhaust catalyst) is shown arranged along exhaust passage 48 downstream of exhaust gas sensor 126. Device 70 may be a three way catalyst (TWC), NOx trap, various other emission control devices, or combinations thereof. In some embodiments, during operation of engine 5, emission control device 70 may be periodically reset by operating at least one cylinder of the engine within a particular air/fuel ratio.

Engine 5 may be cooled via engine cooling system 80. Engine cooling system 80 is configured to route coolant (such as water) through engine 5. For example, coolant that has circulated through engine 5 may exit the engine and be cooled via one or more radiators 82. The cooled coolant may be pumped back to the engine via pump 90. In some embodiments, cooling system 80 may include a coolant flow control valve 212, which can receive input from controller 20. The coolant flow control valve can be shut to constrict flow of coolant through engine cooling system 80, creating inefficiency in coolant pump 90 which generates heat transferable to the coolant. In one embodiment, constricting of passageway 84 is enacted only when the vehicle is decelerating so as to reduce negative impact on fuel consumption and overall engine inefficiency. Similarly, this coolant heating mode of operation is used when the coolant temperature is below a predefined threshold temperature.

Controller 20 is shown in FIG. 2 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 20 may receive various signals from sensors coupled to engine 5, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 20 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

Storage medium read-only memory 106 can be programmed with computer readable data representing instructions executable by processor 102 for performing the methods described below as well as other variants that are anticipated but not specifically listed.

As described above, FIG. 2 shows only one cylinder of a multi-cylinder engine, and that each cylinder may similarly include its own set of intake/exhaust valves, fuel injector, spark plug, etc. Combustion in engine 5 can be of various types, depending on operating conditions. While FIG. 2 depicts a compression ignition engine, it will be appreciated that the embodiments described herein may be used in any suitable engine, including but not limited to, diesel and gasoline compression ignition engines, spark ignition engines, direct or port injection engines, etc. Further, various fuels and/or fuel mixtures such as diesel, bio-diesel, etc, may be used.

The engine cooling system described above may be regulated to maintain the coolant and hence the engine at a setpoint temperature. By doing so, emissions may be controlled while maintaining the engine at a safe operating temperature. However, upon engine start up the coolant is often below the optimal temperature until the engine has thoroughly warmed up. The object of the present disclosure is to more rapidly heat the coolant to a setpoint temperature to increase engine efficiency.

Figure 3:
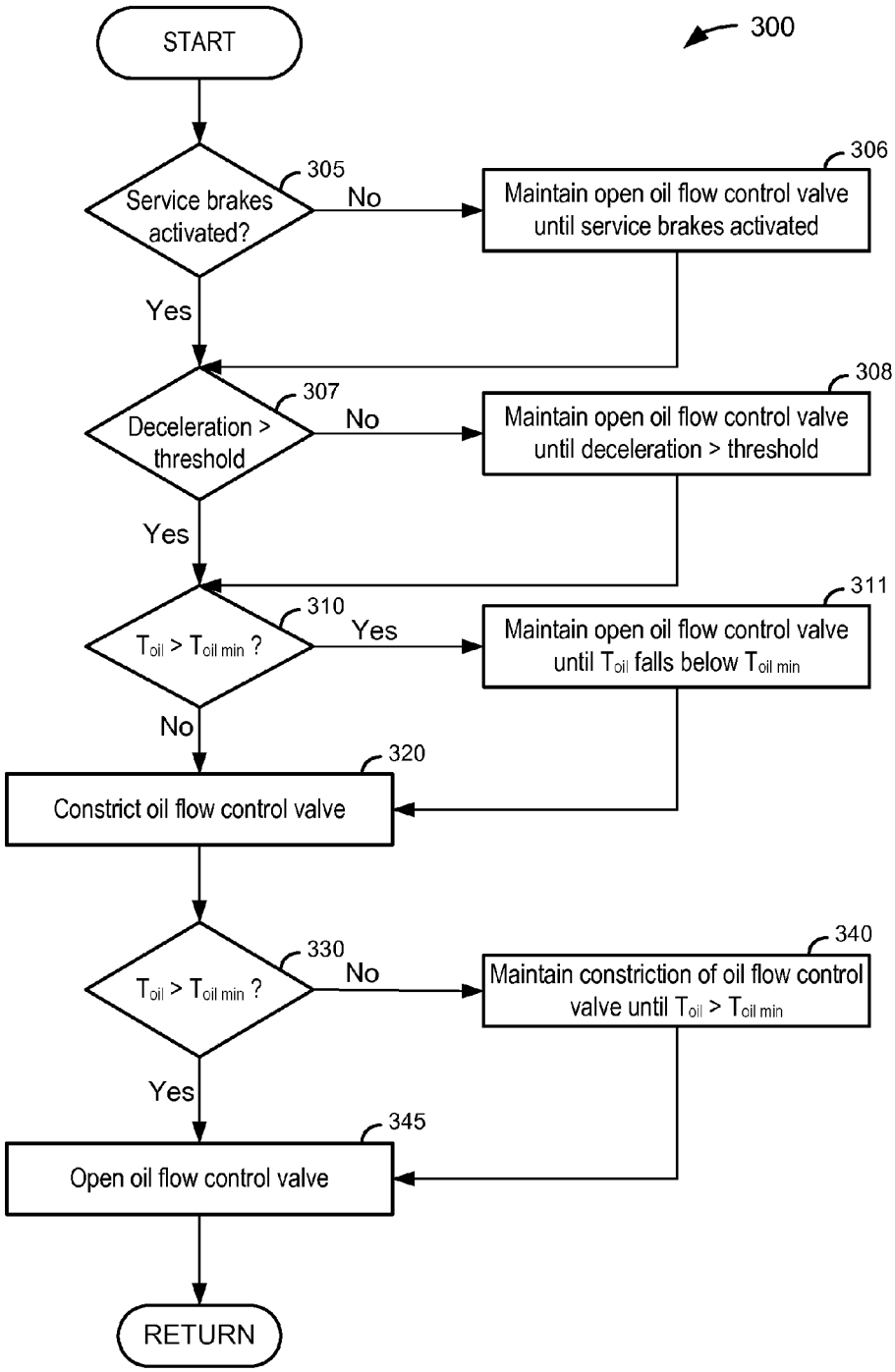
FIG. 3 shows a method to expedite engine warm up by inefficient operation of an oil pump.

Referring now in particular to FIG. 3 there is shown a method for improving the warm-up of the engine 5 (shown in FIG. 1*a*) by inefficient operation of an oil pump. The method 300 starts with a key-on event and then advances to box 305. In box 305 it is determined by brake sensor 53 whether the service brakes 50 have been activated. If the service brakes 50 have not been activated, the result of the test in box 305 is NO, the method 300 proceeds to 306 where the normal oil operating mode is maintained by keeping oil flow control valve 12 open until service brakes are activated. If the service brakes have been activated at 305 (YES) it is then determined whether deceleration exceeds a predefined threshold at 307. Deceleration can be determined by accelerometer 55 or by monitoring the rate of change in engine speed by controller 20. If the predefined deceleration threshold is not exceeded then this would be interpreted as a NO result to the test in box 307 and the method proceeds to 308 where oil flow control valve 12 is kept open until deceleration exceeds threshold. As described above, the predefined threshold for deceleration could be based on vehicle characteristics, for example vehicle weight, additional power demands on the motor and operating speed. If this deceleration threshold has been exceeded at 307 (YES), method 300 proceeds to 310. Operation of oil heating mode above a predefined threshold for deceleration when the service brakes have been activated minimizes additional demands on the engine 5 via mechanical shaft 7 to power oil pump 10. Operating oil heating mode under these conditions will minimize negative impact to fuel economy and overall engine inefficiency.

In box 310 the temperature of the oil ($T_{oil}$) is compared to a predefined oil temperature limit ($T_{oilmin}$). This comparison is done by the electronic controller 20 based upon a measurement of oil temperature obtained from the temperature sensor 21 and a stored value for $T_{oilmin}$. $T_{oilmin}$ is a temperature where the viscosity of the oil will have fallen to an acceptable level thereby minimising the disadvantages referred to above.

If in box 310 the temperature of the oil is determined to be greater than $T_{oilmin}$ (YES) then the method advances to box 311 where oil flow control valve 12 is maintained open until $T_{oil}$ falls below $T_{oilmin}$. This would be the case where the engine 5 is restarted after a short period of time has elapsed or where the location of the engine 5 is an environment with a high ambient temperature such as for example 40° C.

If, in box 310, the oil temperature is determined to be below the predefined temperature limit $T_{oilmin}$ (NO) then the method advances to box 320 where oil heating mode is activated that is to say, oil flow control valve 12 is constricted so as to require more work of oil pump 10. This inefficiency creates heat which is transferred to the oil. Therefore, for oil heating to occur, the temperature of the oil will be below the predefined temperature limit $T_{oilmin}$ and the motor vehicle 1 will be decelerating at a rate greater than threshold.

Although as described above this heating mode is brought about by restricting the flow of oil exiting the pump 10 by constricting flow control valve 12, it will be appreciated that with some designs of pump an alternative heating mechanism could be used. For example, the pump 10 could be reconfigured or adjusted into an inefficient mode of operation where stalling or excessive turbulence is produced within the pump thereby generating heat in the oil.

After box 320 the method advances to box 330 where the temperature of the oil ($T_{oil}$) is compared to a predefined oil temperature limit ($T_{oilmin}$). As before, this comparison is done by the electronic controller 20 based upon a measurement of oil temperature obtained from the temperature sensor 21 and a stored value for $T_{oilmin}$. If in box 330 the temperature of the oil is determined to be greater than $T_{oilmin}$ (YES) then the method advances to box 345 where oil flow control valve 12 is opened. If in box 330 the oil temperature is determined to be below the predefined temperature limit $T_{oilmin}$ (NO) then the method advances to box 340 where the constriction of oil flow control valve 12 is maintained until $T_{oil}$ exceeds $T_{oilmin}$. Once $T_{oil}$ has exceeded $T_{oilmin}$, method 300 proceeds to 345 where the oil flow control valve 12 is opened fully. Method 300 then ends because no further heating of the oil is useful.

Method 300 provides instructions for an engine controller to operate an oil pump inefficiently during vehicle deceleration to speed the warm up of engine oil. In other embodiments, as described above, the heating mode of operation may be initiated at times when the vehicle is not explicitly decelerating, such as during downhill descent in an over-run situation, without requiring additional work of the engine which negatively influences fuel economy. This would allow more rapid engine warm up, but may negatively impact overall engine efficiency as it requires additional work of the engine to power the oil pump inefficiently. Additionally, a similar method of inefficient pump operation can be used for additional or alternate liquid circuits. A method for operation of a coolant pump inefficiently to speed warm up of coolant is described below.

Figure 4:
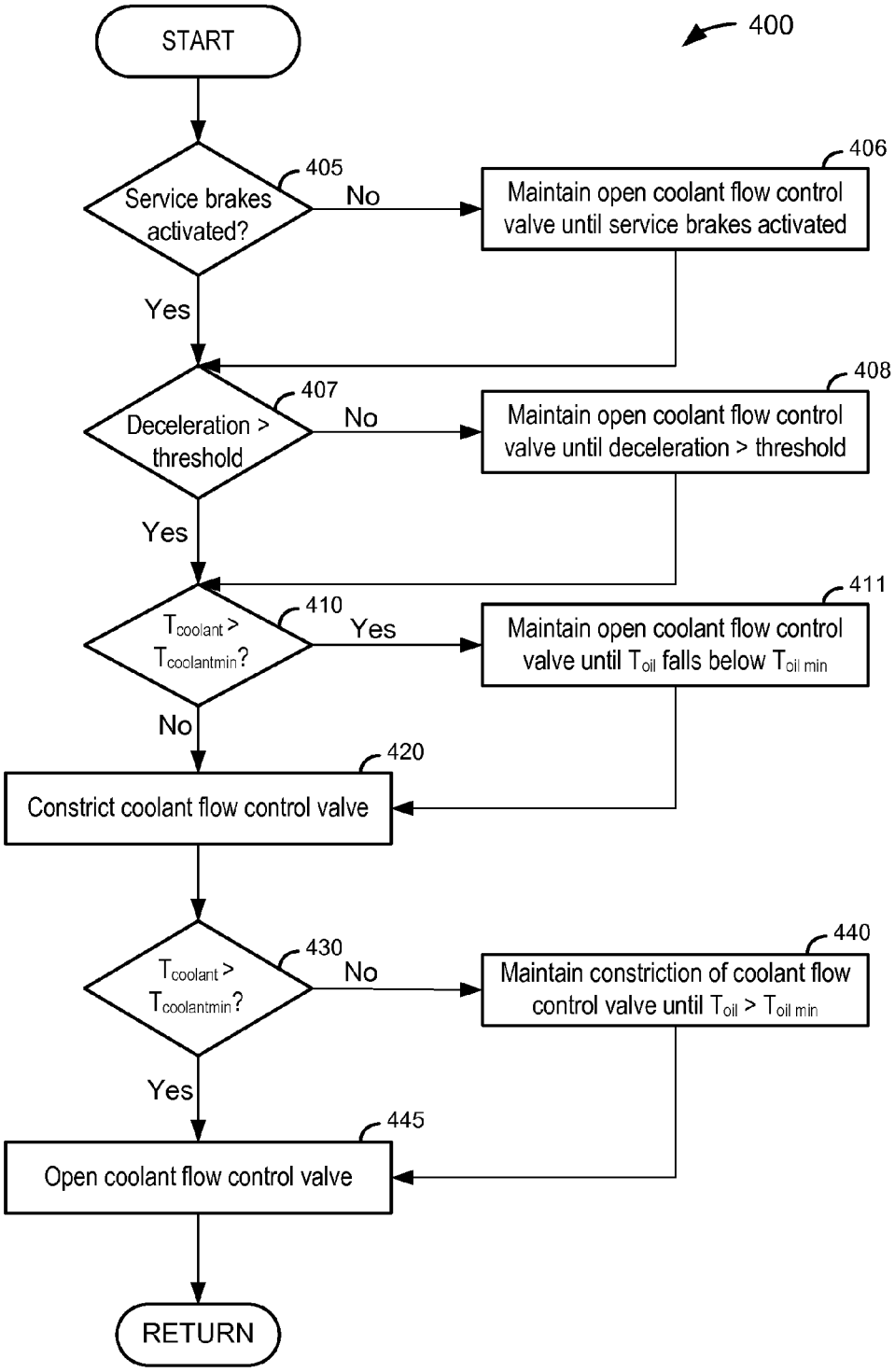
FIG. 4 shows a method to expedite engine warm up by inefficient operation of a coolant pump.

Referring now to FIG. 4, a method 400 is provided for an engine controller to command a coolant flow control valve based on coolant temperature and engine operating conditions. Method 400 is substantially similar to method 300 depicted in FIG. 3, except in that method 400 applies to a coolant circuit and not an oil circuit like method 300, as shown in FIG. 3.

The method 400 starts with a key-on event and then advances to box 405. In box 405 it is determined whether the service brakes 50 have been activated. If the service brakes 50 have not been activated, the result of the test in box 405 is NO, the method 400 proceeds to 406 where the normal coolant operating mode, where coolant flow control valve 212 is open, is maintained until service brakes are activated. If the service brakes have been activated at 405 (YES) it is then determined whether deceleration exceeds a predefined threshold at 407. If the predefined deceleration threshold is not exceeded then this would be interpreted as a NO result to the test in box 407 and the method proceeds to 408 where coolant flow control valve 212 is maintained open until deceleration exceeds threshold. As described above, the predefined threshold for deceleration could be based on vehicle characteristics, for example vehicle weight, additional power demands on the motor and operating speed. If this deceleration threshold has been exceeded at 407 (YES), method 400 proceeds to 410. Operation of coolant heating mode above a predefined threshold for deceleration when the services brakes have been activated minimizes additional demands on the engine 5 to power coolant pump 90. Operating coolant heating mode under these conditions will minimize negative impact to fuel economy and overall engine inefficiency.

In box 410 the temperature of the coolant ($T_{coolant}$) is compared to a predefined coolant temperature limit ($T_{coolantmin}$). This comparison is done by the electronic controller 20 based upon a measurement of coolant temperature obtained from the temperature sensor 112 and a stored value for $T_{coolantmin}$. $T_{coolantmin}$ is a temperature where the viscosity of the coolant will have fallen to an acceptable level thereby minimising the disadvantages referred to above.

If in box 410 the temperature of the coolant is determined to be greater than $T_{coolantmin}$ (YES) then the method advances to box 411 where coolant flow control valve 212 is maintained open until $T_{coolant}$ falls below $T_{coolantmin}$. This would be the case where the engine 5 is restarted after a short period of time has elapsed or where the location of the engine 5 is an environment with a high ambient temperature such as for example 40° C.

If in box 410 the coolant temperature is determined to be below the predefined temperature limit $T_{coolantmin}$ (NO) then the method advances to box 420 where coolant heating mode is activated that is to say, controller 20 instructs coolant flow control valve to operate in the coolant heating mode of operation. In the coolant heating mode of operation flow control valve 212 is constricted so as to require more work of coolant pump 90. This inefficiency creates heat which is transferred to the coolant. Therefore, for coolant heating to occur, the temperature of the coolant will be below the predefined temperature limit $T_{coolantmin}$ and the motor vehicle 1 will be decelerating at a rate greater than threshold.

Although as described above, this heating mode is brought about by restricting the flow of coolant exiting the coolant pump 90 by constricting coolant flow control valve 212, it will be appreciated that with some designs of pump an alternative heating mechanism could be used. For example, the coolant pump 90 could be reconfigured or adjusted into an inefficient mode of operation where stalling or excessive turbulence is produced within the pump thereby generating heat in the coolant.

After box 420 the method advances to box 430 where the temperature of the coolant ($T_{coolant}$) is compared to a predefined coolant temperature limit ($T_{coolantmin}$). As before, this comparison is done by the electronic controller 20 based upon a measurement of coolant temperature obtained from the temperature sensor 15 and a stored value for $T_{coolantmin}$. If in box 430 the temperature of the coolant is determined to be greater than $T_{coolantmin}$ (YES) then the method advances to box 445 where normal coolant operation mode is restored by opening coolant flow control valve 212. Method 400 then ends because no further heating of the coolant is useful.

If in box 430 the coolant temperature is determined to be below the predefined temperature limit $T_{coolantmin}$ (NO) then the method advances to box 440 where coolant heating mode is maintained until $T_{coolant}$ exceeds $T_{coolantmin}$.

Method 400 provides instructions for an engine controller 20 to carry out the method of the current disclosure specific to a coolant circuit, such as engine cooling system 80 described in FIG. 2. The method as it appears here is independent of temperatures within an engine oil circuit. However, the methods 300 and 400 could be interdependent. Operation of both oil and coolant heating modes simultaneously using temperature sensors from one of the liquid circuits to determine if threshold temperature has been reached would be possible for liquids and circuits that warm up at similar rates. This embodiment of the present disclosure reduces the need for additional sensors and instructions to and from controller 20. Additionally, in other embodiments, as described above, the heating mode of operation may be initiated at times when the vehicle is not explicitly decelerating, such as during downhill descent in an over-run situation, without requiring additional work of the engine which negatively influences fuel economy.

The object of the present disclosure is a method for an engine comprising opening a flow control valve in a liquid circuit when the temperature of the liquid within the liquid circuit is above a predefined threshold temperature. When a temperature of the liquid is below the predefined threshold temperature and a vehicle deceleration rate is above a predefined deceleration rate, constricting the flow of the liquid within the liquid circuit. Inefficient operation of a pump, for example an oil pump, in this way produces heat which is transferable to the liquid, oil in this example, rapidly heating the oil. Inefficient operation of the pump while the vehicle is decelerating at a rate higher than a predefined threshold minimizes the negative impact of intentional inefficient operation of the pump on overall engine efficiency and fuel economy. Heating of engine oil reduces its viscosity and thus reduces friction on engine components. With the present disclosure, engine warm up occurs more readily than a traditional engine warm up which relies on normal operating conditions. Reliance on normal operating conditions results in slower heating of engine oil compared to the method of the present disclosure. Furthermore, utilizing the method of the present disclosure for rapid heating of the engine coolant has the advantage of further decreasing the engine warm up phase. Shortening this warm up phase has the advantage of lessening wear on engine components and increasing overall efficiency.

It will be appreciated by those skilled in the art that although the disclosure has been described by way of example with reference to one or more embodiments it is not limited to the disclosed embodiments and that one or more alternative embodiments could be constructed without departing from the scope of the disclosure as defined by the appended claims.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types including diesel and gasoline compression ignition engines, spark ignition engines, direct or port injection engines, etc. Further, various fuels and/or fuel mixtures such as diesel, bio-diesel, etc, may be used. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for improving warm-up of an engine of a vehicle comprising:

operating a flow control valve positioned downstream of a pump to circulate a liquid through the engine via a return line positioned downstream of the flow control valve;

operating the pump in a normal operating mode when the liquid is above a predefined threshold temperature; and activating a heating mode of operation for the pump if the vehicle is decelerating and the liquid is below the predefined threshold temperature;

wherein, in the heating mode of operation, the pump is operated less efficiently than in the normal mode so as to generate more heat transferable from the pump to the liquid passing through the pump.

2. The method as claimed in claim 1, wherein the vehicle further comprises service brakes to decelerate the vehicle in response to a driver input, and further comprising activating the heating mode of operation to heat the liquid passing through the pump if the service brakes of the vehicle have been activated.

3. The method as claimed in claim 2, wherein the method further comprises activating the heating mode of operation to heat the liquid passing through the pump if the service brakes of the vehicle have been activated sufficiently to produce a deceleration of the vehicle above a predefined level.

4. The method as claimed in claim 1, wherein, in the heating mode of operation, a flow of liquid from the pump is more restricted than in the normal mode so as to generate more heat transferable to the liquid passing through the pump.

5. The method as claimed in claim 1, wherein the pump is driven by the engine.

6. The method as claimed in claim 1, wherein the liquid is oil.

7. A vehicle comprising:

an engine;

a flow control valve positioned downstream of a pump operable in a normal operating mode and a heating mode of operation to circulate a liquid through the engine; and a controller, wherein the controller is operable to operate the flow control valve in the heating mode of operation to heat the liquid passing through the pump only if the vehicle is decelerating;

wherein, in the heating mode of operation, the pump is operated less efficiently than in the normal mode so as to generate more heat transferable from the pump to the liquid passing through the pump.

8. The vehicle as claimed in claim 7, further comprising service brakes to decelerate the vehicle in response to a driver input, and the controller is operable to operate the flow control valve in the heating mode of operation to heat the liquid passing through the pump if the service brakes of the vehicle have been activated.

9. The vehicle as claimed in claim 8, wherein the controller is operable to operate the flow control valve in the heating mode of operation to heat the liquid passing through the pump if the service brakes of the vehicle have been activated sufficiently to produce a deceleration of the vehicle above a predefined level.

10. The vehicle as claimed in claim 9: wherein the controller is operable to operate the flow control valve in the heating mode of operation if a temperature of the liquid passing through the pump is below a predefined temperature.

11. The vehicle as claimed in claim 7, wherein the pump is driven by the engine.

12. The vehicle as claimed in claim 7, wherein the liquid is one of oil and coolant.

13. The vehicle as claimed in claim 7, wherein the vehicle has an oil pump and a coolant pump, each operable in a normal operating mode and a heating mode of operation to circulate a respective liquid through the engine, and the controller is operable to operate the flow control valve in the heating mode of operation to heat the respective liquid passing through the oil pump and the coolant pump if the vehicle is decelerating.

14. A method for an engine comprising:

opening a flow control valve in an oil circuit when a temperature of oil within the oil circuit is above a predefined threshold temperature; and constricting the flow of oil within the oil circuit by turning a butterfly valve only when a temperature of the oil is below the predefined threshold temperature and a vehicle is operating in an over-run situation.

15. The method as claimed in claim 14, further comprising constricting the flow of oil within the oil circuit by routing the flow of the oil through a restricted line, the restricted line being blocked to the flow of the oil when the temperature of the oil is above a predefined threshold temperature.

16. The method as claimed in claim 15, further comprising constricting the flow of oil within the oil circuit by routing the flow of the oil through the restricted line which is of smaller diameter than lines that are not blocked when the temperature of the oil is above a predefined threshold temperature.

* * * * *